US005981927A

United States Patent [19]

Osepchuk et al.

[11] Patent Number: 5,981,927

[45] Date of Patent: Nov. 9, 1999

[54] HIGH VISIBILITY MICROWAVE OVEN DOOR WITH SCREEN AND MICROWAVE ABSORBING MATERIAL

[76] Inventors: John Osepchuk, 248 Deacon Haynes Rd., Concord, Mass. 01742; Thomas L. Miller, 1336 520th St. SW., Wellman, Iowa 52356; Rex E. Fritts, 3905 Northwood Dr. NE., Cedar Rapids, Iowa 52402

[21] Appl. No.: 08/767,235

[22] Filed: Dec. 13, 1996

[51] Int. Cl.[6] ..... H05B 6/76

[52] U.S. Cl. ..... 219/740; 219/744; 126/198; 174/35 MS

[58] Field of Search ..... 219/740, 744, 219/739, 741; 126/198, 200; 174/35 R, 35 MS, 35 GC

[56] References Cited

U.S. PATENT DOCUMENTS

| | | | |
|---|---|---|---|
| 2,920,174 | 1/1960 | Haagensen | 219/740 |
| 4,695,694 | 9/1987 | Hill et al. | 219/740 |
| 4,745,247 | 5/1988 | Fukumoto | 219/740 |

FOREIGN PATENT DOCUMENTS

| | | | |
|---|---|---|---|
| 30 32 998 | 4/1982 | Germany | 219/740 |
| 57-43131 | 3/1982 | Japan | 219/740 |
| 1-21890 | 1/1989 | Japan | 219/740 |
| 1-115086 | 5/1989 | Japan | 219/740 |
| 2 239 149 | 6/1991 | United Kingdom . | |
| 2 280 829 | 2/1995 | United Kingdom . | |

OTHER PUBLICATIONS

TECHNIT, Data Sheet EMC–710, Copyright 1972 Technical Wire Products, Inc.

UK Search Report, dated Apr. 16, 1998, Application No. GB 9726489.9.

*Primary Examiner*—Philip H. Leung

*Attorney, Agent, or Firm*—Tobor, Goldstein & Healey, LLP

[57] ABSTRACT

A microwave oven comprises a cabinet and a door attached to the cabinet to form a food processing chamber. The door has a screen, an absorbing film, and a frame. The screen reflects microwave energy away from the absorbing film, the screen has a plurality of screen lines and a plurality of screen openings defined by the plurality of screen lines, and the screen has a screen period. The absorbing film absorbs microwave energy passing through the screen. The frame supports the screen and the absorbing film in order to form a window through the door and to maintain leakage of microwave energy through the door from the food processing chamber below a predetermined level. The frame supports the screen and the absorbing film so that the screen and the absorbing film are separated by a distance which is as least as great as the screen period, and the screen and the absorbing film are electrically attached to the frame.

44 Claims, 2 Drawing Sheets

FIG. 3
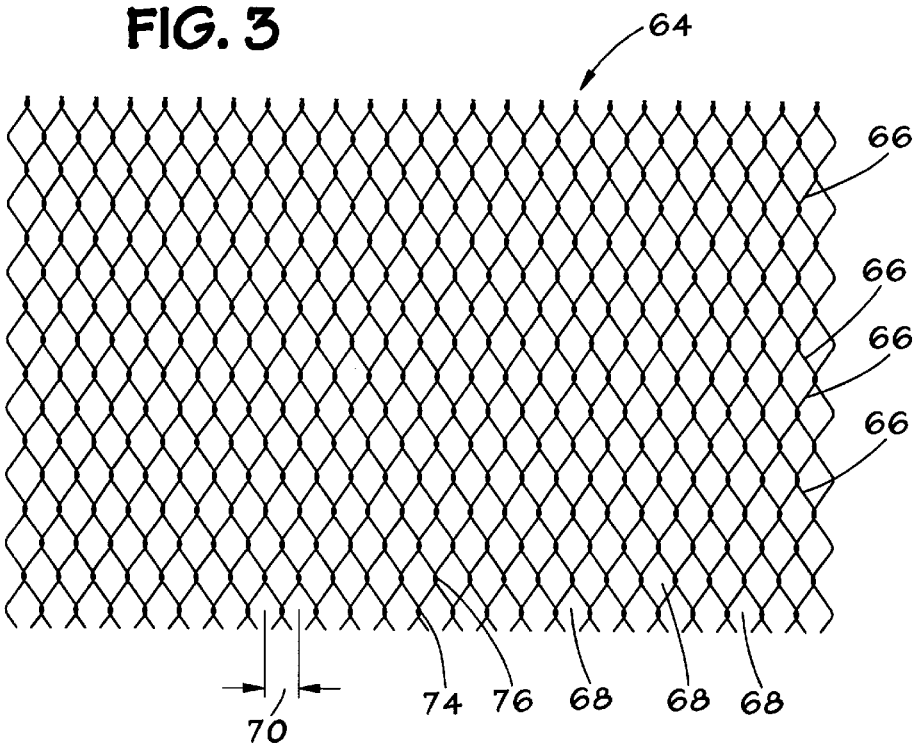
FIG. 5
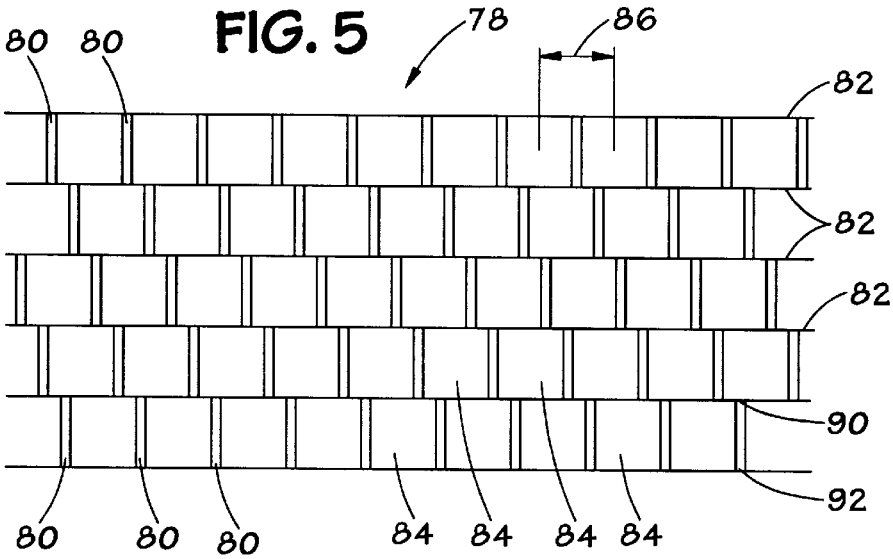
FIG. 4
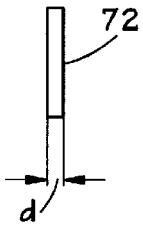
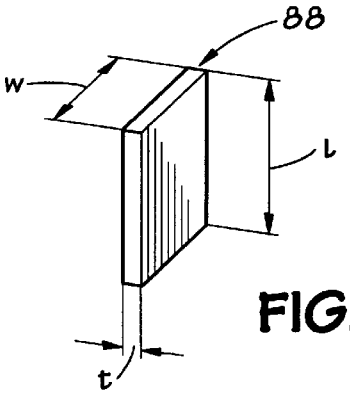
FIG. 6

HIGH VISIBILITY MICROWAVE OVEN DOOR WITH SCREEN AND MICROWAVE ABSORBING MATERIAL

TECHNICAL FIELD OF THE INVENTION

The present invention is directed to a microwave oven door having improved visibility.

BACKGROUND OF THE INVENTION

An oven, such as a microwave oven or a combination oven which, for example, combines microwave cooking with other forms of cooking (e.g., convection cooking), typically includes an oven body and an oven door. The oven body defines an oven chamber within which food may be processed, and the oven door interacts with the oven body to permit access to the oven chamber.

A typical oven door, which is used on a microwave oven, has a window, usually in the form of a screen, for preventing leakage of the microwave RF energy that is generated by the oven to process the food in the oven chamber. The function of the screen is to attenuate the RF energy, which would otherwise leak through the oven door, to a level that meets government and/or industry standards. At the same time, the screen must be transparent enough to permit a user to view the contents of the oven chamber when the oven door is closed and the oven is processing food.

Unfortunately, if the screens of current oven doors are made transparent enough to be satisfactory to users, the oven doors do not sufficiently attenuate RF energy. Accordingly, unacceptable levels of RF energy leak through such oven doors. On the other hand, if sufficient RF energy is attenuated by the screens so that unacceptable levels of RF energy do not leak through the corresponding oven doors, the screens of current oven doors are not transparent enough to be acceptable to users. Accordingly, an oven door having excellent visibility is not practical when a single metal mesh is used as the only means to attenuate RF energy.

The present invention is directed to an oven door which is transparent enough to provide excellent visibility to users and which attenuates RF energy to an acceptable level.

SUMMARY OF THE INVENTION

According to a first aspect of the present invention, a door for a microwave oven comprises a screen, an absorbing film, and a frame. The screen reflects microwave energy. The absorbing film absorbs microwave energy. The frame supports the screen and the absorbing film so as to form a window through the door and to maintain leakage of microwave energy through the door below a predetermined level.

According to another aspect of the present invention, a door for a microwave oven comprises a reflecting means, an absorbing means, and a supporting means. The reflecting means reflects microwave energy. The absorbing means absorbs microwave energy. The supporting means supports the reflecting means and the absorbing means so that the reflecting means and the absorbing means form a window through the door, so that the reflecting means and the absorbing means maintain leakage of microwave energy through the door below a predetermined level, and so that the reflecting means and the absorbing means are electrically attached to the supporting means.

According to yet another aspect of the present invention, a microwave oven comprises a cabinet and a door attached to the cabinet so as to form a food processing chamber. The door comprises a screen, an absorbing film, and a frame. The screen reflects microwave energy, the screen has a plurality of screen lines and a plurality of screen openings defined by the plurality of screen lines, and the screen has a screen period. The absorbing film absorbs microwave energy. The frame supports the screen and the absorbing film so as to form a window through the door and to maintain leakage of microwave energy through the door from the food processing chamber below a predetermined level, the frame supports the screen and the absorbing film so that the screen and the absorbing film are separated by a distance which is as least as great as the screen period, and the screen and the absorbing film are electrically attached to the frame.

BRIEF DESCRIPTION OF THE DRAWINGS

These and other features and advantages of the present invention will become more apparent from a detailed consideration of the invention when taken in conjunction with the drawings in which:

FIG. 3 illustrates a section of a screen of the oven door shown in FIG. 2;

FIG. 4 shows a line segment of the screen section shown in FIG. 3;

FIG. 5 illustrates a section of an alternative screen of the oven door shown in FIG. 2; and, FIG. 6 shows a line segment of the screen section shown in FIG. 5.

DETAILED DESCRIPTION

Figures 1, 2:
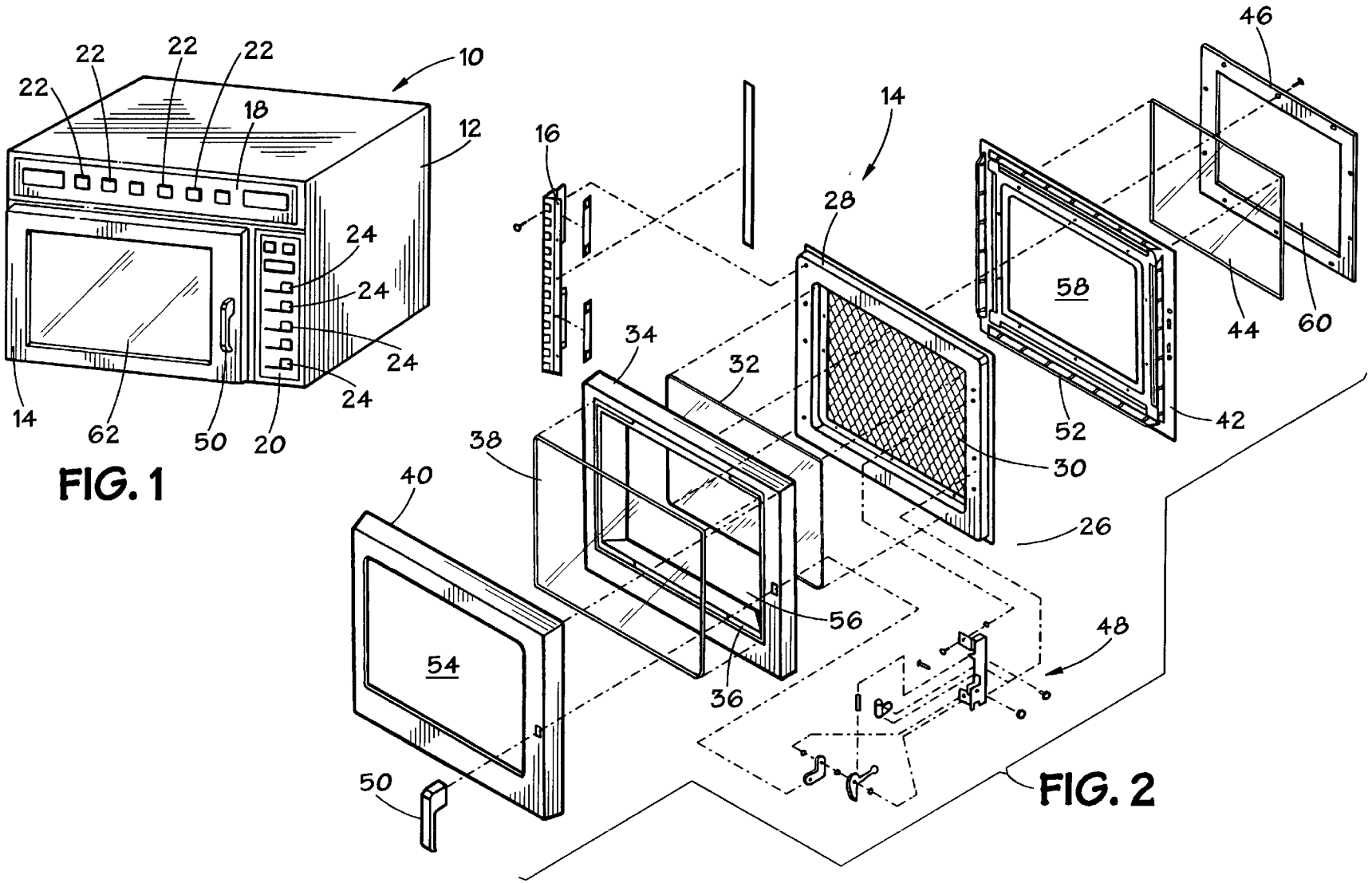
FIG. 1 is an isometric view of a microwave oven having an oven door according to the present invention.
FIG. 2 is an assembly view of an oven door according to the present invention.

FIG. 1 illustrates an oven 10 having an oven body 12 and an oven door 14 attached thereto. When the oven door 14 is to be attached to the oven body 12, a door hinge 16 (FIG. 2) is fastened to the oven body 12 and to the oven door 14 so that the oven door 14 may be opened and closed with respect to the oven body 12. Accordingly, the oven door 14 may then be opened in order to permit access to an oven chamber of the oven body 12.

The oven body 12 has two control areas 18 and 20. The control area 18 may include a plurality of switches 22 for controlling the oven 10 according to desired cooking procedures (time and temperature) which are not preprogrammed into the oven 10. The control area 20 may include a plurality of switches 24 for initiating preprogrammed cooking procedures of the oven 10. The control areas 18 and 20 may also include various indicating displays.

As shown in FIG. 2, the oven door 14 includes a choke assembly 26 having a frame 28, a screen 30, and an RF absorbing film 32. The screen 30 may be a woven wire mesh, a stretched or expanded metal mesh, or the like. The RF absorbing film 32 may be an ALTAIR-M film supplied by Southwall Technologies, or any other suitable absorbing film. Preferably, an absorbing film having about 84% transparency and an attenuation of about 20 dB at the frequency (typically 2450 MHz) of the RF energy produced by the typical microwave oven should be selected for the RF absorbing film 32. The choke assembly 26, as is typical, may include a choke cavity (not shown) and choke fingers (not shown) that are arranged to further attenuate leakage of RF energy from the cooking chamber through the oven door 14 of the oven 10 to the oven's exterior. The screen 30 may be suitably attached on one side of the frame 28, and the RF absorbing film 32 may be suitably attached on the other side of the frame 28.

The oven door 14 includes a first panel retainer 34 which has a panel receiving flange 36 that supports a first panel 38. The first panel 38 may be a transparent glass panel. A first cover ring 40, which may be stamped stainless steel, is arranged to snap fit onto the first panel retainer 34. Accordingly, the first cover ring 40 snaps onto the first panel retainer 34 and holds the first panel 38 against the panel receiving flange 36 of the first panel retainer 34.

The oven door 14 also includes a second panel retainer 42 which has a panel receiving flange (not shown) that supports a second panel 44. The second panel 44 may be a transparent glass panel. A second cover ring 46 is arranged to hold the second panel 44 against the second panel retainer 42.

When the oven door 14 as shown in FIG. 2 is assembled, fasteners (shown by dashed lines in FIG. 2) are inserted through one or more fastener receiving holes of the second cover ring 46, through corresponding fastener receiving holes of the second panel retainer 42, and into corresponding fastener receiving holes of the first panel retainer 34. These fasteners may be screws which, when tightened, thread into the first panel retainer 34. As the fasteners are tightened, (i) the second cover ring 46 exerts a force on the second panel 44 to hold the second panel 44 against the panel receiving flange of the second panel retainer 42, and (ii) the second panel retainer 42 exerts a force on the frame 28 so as to wedge the choke assembly 26, with the screen 30 and the RF absorbing film 32, against the first panel retainer 34. The first panel 38 is placed against the panel receiving flange 36 of the first panel retainer 34, and the first cover ring 40 is snapped onto the first panel retainer 34 in order to hold the first panel 38 against the first panel retainer 34. The RF absorbing film 32 should be held taught in the final door assembly so that the separation between the screen 30 and the RF absorbing film 32 is approximately constant. Alternatively, the RF absorbing film 32 can be stretched over, and supported by, a rigid transparent member so as to uniformly separate the screen 30 and the RF absorbing film 32.

Also, a latch assembly 48 is secured to the frame 28, and a handle 50 is secured to a part of the latch assembly 48 which extends through the first panel retainer 34 and the first cover ring 40 as illustrated in FIG. 2. The oven door 14, at this stage, is now ready for fastening to the oven body 12 by use of the door hinge 16. Once the oven door 14 is fastened to the oven body 12 by use of the door hinge 16, the oven door 14 may be opened and closed about the door hinge 16 with respect to the oven body 12 by use of the handle 50.

The second panel 44, together with the second panel retainer 42 and the second cover ring 46, prevent contaminants within the oven chamber of the oven body 12 from soiling the choke assembly 26. If desired, a gasket 52 may be provided between the second panel retainer 42 and the frame 28 to provide an additional contaminant seal for the choke assembly 26. Accordingly, cleaning of the oven 10 is enhanced.

The first cover ring 40 has an opening 54 which aligns with (i) the first panel 38, (ii) an opening 56 of the first panel retainer 34, (iii) the RF absorbing film 32, (iv) the screen 30, (v) an opening 58 of the second panel retainer 42, (vi) the second panel 44, and (vii) an opening 60 of the second cover ring 46. Accordingly, a substantially transparent window 62 (FIGS. 1 and 2) is formed through the oven door 14 so that a user may see through the oven door 14 and into the oven chamber while food is being processed by the oven 10.

The second cover ring 46 is preferably made of a microwave safe material. Such a material is transparent to RF energy and is capable of withstanding temperatures in excess of 500° F. without warpage or other structural impairment. Such a material is also temperature resistant, non-hygroscopic (does not absorb moisture), flame resistant, non-toxic (meets National Sanitation Foundation standards), non-brittle, cleaner resistant, and animal fats and food byproducts resistant. Accordingly, the material used for the second cover ring 46, for example, may be a thermoplastic polyimide having a 40% mineral fill. The fill may be glass or any other suitable mineral. The thermoplastic polyimide may be supplied by RTP Company under catalog number 4299X-65690BLK.

The second panel retainer 42 is also preferably made of a microwave safe material and has the other characteristics of the second cover ring 46. However, because the second panel retainer 42 is more removed from the cooking chamber of the oven 10 than the second cover ring 46, the material of the second panel retainer 42 need not withstand as high a temperature as the second cover ring 46. The material for the second panel retainer 42, for example, is sufficient if it withstands temperatures of around 350° F. The material, which may be used for the second panel retainer 42, may be a thermal set vinyl ester having approximately 15% glass, 2% titanium oxide, and 60% calcium carbonate which can be ordered under catalog number 840-6506 from BMC (Bulk Molding Compounds, Inc.).

The gasket 52 of the second panel retainer 42 may be silicon which is supplied by Rubber Industries (under catalog number RII0408). The first panel retainer 34 may be material which can withstand temperatures of around 350° F. For example, the first panel retainer 34 may be a polyphenylsulfone having 5% glass and supplied under catalog number 1699X67814A by RTP Company.

As described above, the substantially transparent window 62 of the oven door 14 permits the user to see through the oven door 14 and into the oven chamber while food is being processed by the oven 10. Also, the oven door 14 attenuates leakage therethrough of the RF energy generated by the oven door 10. It is generally required that the leakage of RF energy through a microwave oven be no more than 0.01 $mW/cm^2$.

Thus, for example, if the oven 10 generates 1000 Watts of RF energy and the screen 30 has an area of 1000 $cm^2$, the power density that the screen 30 experiences is 1 $Watt/cm^2$. In order for the oven door 14 to attenuate the 1 $Watt/cm^2$ power density down to a leakage of not more than 0.01 $mW/cm^2$, the oven door 14 must provide an attenuation of at least 50 dB. When ALTAIR-M film is selected for the RF absorbing film 32, the RF absorbing film 32 provides about 20 dB of attenuation at the frequency of 2450 MHz. Accordingly, the screen 30 must provide about 30 dB of additional attenuation.

A section 64 of the screen 30 is shown in FIG. 3. The section 64 is comprised of a plurality of wires 66 forming a plurality of see-through openings 68. The distance between the centers of adjacent openings is defined as the screen period of the screen 30. This screen period is designated as a screen period 70 in FIG. 3. As shown in enlarged form in FIG. 4, a wire segment 72 of the wires forming the screen 30 extends along one side of an opening 68 of the screen 30. For example, the wire segment 72 may extend between points 74 and 76 of the section 64. The wire segment 72 has a diameter d (which may alternatively be referred to as thickness).

The transparency of the screen 30 depends upon the magnitude of the screen period 70 and the wire diameter d.

For example, a screen having a screen period of about 0.125" and a wire diameter d of about 0.020" has about a 71% transparency. This screen attenuates RF energy by about 30.42 dB. As another example, a screen having a screen period of about 0.0625" and a wire diameter d of about 0.00625" has about an 81% transparency. This screen attenuates RF energy by about 34.7 dB.

Alternatively, the screen 30 may be a metallic honeycomb having a plurality of fins sandwiched between a plurality of metallic layers. A section 78 of such a screen is shown in FIG. 5. The section 78 is a honeycomb comprised of a plurality of vertically disposed metallic lines 80, in the form of fins, sandwiched between a plurality of horizontally disposed metallic lines 82 thereby forming a plurality openings 84. The distance between the centers of adjacent openings is defined as the screen period. This screen period is designated as a screen period 86 in FIG. 5.

As shown in enlarged form in FIG. 6, a line segment 88 of the lines 80 forming the section 78 extends along one side of an opening 84. For example, the line segment 88 may extend betweens points 90 and 92 of the section 78. The line segment 88 has a line segment length l, a line segment width w, and a line segment thickness t. The line segment thickness t is horizontally perpendicular to the user's line of sight as the user looks through the oven door 14 when the oven door 14 is closed as shown in FIG. 1. The line segment width w is along the user's line of sight as the user looks through the oven door 14 when the oven door 14 is closed as shown in FIG. 1. The line segment length l is vertically perpendicular to the user's line of sight as the user looks through the oven door 14 when the oven door 14 is closed as shown in FIG. 1.

With the screen of the type shown in FIG. 5, a screen having a screen period of about 0.250", a line segment thickness t of about 0.0125", and a line segment width w of about 0.100" has a transparency of about 90% and an attenuation of about 32.1 dB. A screen having a screen period of about 0.1875", a line segment thickness t of about 0.0094", and a line segment width w of about 0.0564" has a transparency of about 90% and an attenuation of about 31.43 dB. A screen having a screen period of about 0.125", a line segment thickness t of about 0.0063", and a line segment width w of about 0.0189" has a transparency of about 90% and an attenuation of about 30.1 dB. A screen having a screen period of about 0.0625", a line segment thickness t of about 0.00313", and a line segment width w of about 0.00313" has a transparency of about 90% and an attenuation of about 32.9 dB. A screen having a screen period of about 0.0625", a line segment thickness t of about 0.00313", and a line segment width w of about 0.00625" has a transparency of about 90% and an attenuation of about 34.5 dB. As can be seen from these examples, an attenuation of at least 30 dB can be attained with a ratio w/t of about 8 for a large screen period of 0.250" to a ratio w/t of about 1 for a small screen period of 0.0625".

Certain modifications of the present invention have been discussed above. Other modifications will occur to those practicing in the art of the present invention. For example, as described above, the oven door 14 comprises a plurality of parts. However, the oven door 14 may comprise fewer or more parts than shown in the drawings hereof. Also, preferred materials for the parts described above have been disclosed herein. Instead, other suitable materials may be used. For example, the period and the line size of the screen 30, and the particular film that is selected for the RF absorbing film 32, may be varied from those specifically disclosed herein depending upon both the frequency and the magnitude of the RF energy generated by the oven 10. In addition, RF absorbing materials other than ALTAIR-M may be chosen for the RF absorbing film 32.

Moreover, as described above, the section 64 of the screen 30 is comprised of a plurality of wires 66 having wire segments 72, thus implying the wire segments are cylindrical. Instead, however, the wire segments may have a quadrilateral or other shape.

Furthermore, if the screen 30 is a metallic honeycomb having a plurality of fins sandwiched between a plurality of metallic layers as shown in FIG. 5, the fins may be directionally biased so that a user, looking from the right of center of the oven 10, views the center of the interior of the oven 10, and so that a user, looking from the left of center of the oven 10, also views the center of the interior of the oven 10.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A door for a microwave oven, wherein the door has an interior face arranged to face an inside of a microwave oven and an exterior face arranged to face an outside of the microwave oven, the door comprising:

a screen to reflect microwave energy;

an absorbing film to absorb microwave energy; and, a frame supporting the screen and the absorbing film to form a window through the door and to maintain leakage of microwave energy through the door below a predetermined level, wherein the screen and absorbing film are supported by the frame so that the screen is closer to the interior face than is the absorbing film.

2. The door of claim 1 wherein the predetermined level is about 0.01 $mW/cm^2$.

3. The door of claim 1 wherein the predetermined level is established by a standard.

4. The door of claim 1 wherein the screen is arranged to attenuate microwave energy by approximately 30 dB, and wherein the absorbing film is arranged to attenuate microwave energy by approximately 20 dB.

5. The door of claim 1 wherein the screen is arranged to attenuate microwave energy by X dB, wherein the absorbing film is arranged to attenuate microwave energy by Y dB, and wherein X+Y is sufficient to attenuate leakage of microwave energy through the door to substantially not more than the predetermined level.

6. The door of claim 5 wherein the screen has a transparency, wherein the screen has a plurality of lines arranged to form openings having a screen period, wherein the lines have a thickness, wherein the transparency is in a range of about 70% to about 80%, wherein the screen period is in a range of about 0.0625" to about 0.125", and wherein the thickness is in a range of about 0.00625" to about 0.020".

7. The door of claim 5 wherein the screen has a transparency, wherein the screen has a plurality of lines arranged to form openings having a screen period, wherein the lines have a thickness and a width, wherein the transparency is about 90%, wherein the screen period is in a range of about 0.0625" to about 0.250", wherein the thickness is in a range of about 0.00313" to about 0.0125", and wherein the width is in a range of about 0.00313" to about 0.100".

8. The door of claim 5 wherein the screen has a transparency, wherein the screen has a plurality of lines arranged to form openings having a screen period, wherein the lines have a thickness and a width, wherein the transparency is about 90%, wherein the screen period is in a range of about 0.0625" to about 0.250", and wherein a ratio of the width to the thickness is in a range of about 1.0 to about 8.0.

9. The door of claim 1 wherein the screen is more than 70% transparent, and wherein the absorbing film is more than 70% transparent.

10. The door of claim 9 wherein the screen is more than 80% transparent, and wherein the absorbing film is more than 80% transparent.

11. The door of claim 1 wherein the screen attenuates microwave energy, wherein the absorbing film attenuates microwave energy, and wherein the screen and the absorbing film are spaced by a distance so that their attenuations of microwave energy are independent.

12. The door of claim 11 wherein the screen has a screen period, and wherein the distance between the screen and the absorbing film is greater than or equal to the screen period.

13. The door of claim 1 wherein the frame supports the screen and the absorbing film so that the screen reflects microwave energy away from the absorbing film, and so that the absorbing film absorbs microwave energy passing through the screen.

14. A microwave oven comprising:

a cabinet;

a door attached to the cabinet to form a food processing chamber, wherein the door has an interior face arranged to face an inside of the microwave oven and an exterior face arranged to face an outside of the microwave oven, the door comprising a screen to reflect microwave energy, wherein the screen has a plurality of screen lines and a plurality of screen openings defined by the plurality of screen lines, and wherein the screen has a screen period, an absorbing film to absorb microwave energy, and a frame, wherein the frame supports the screen and the absorbing film so as to form a window through the door and to maintain leakage of microwave energy through the door from the food processing chamber below a predetermined level, wherein the frame supports the screen and the absorbing film so that the screen is closer to the interior face than is the absorbing film and the screen and the absorbing film are separated by a distance which is as least as great as the screen period, and wherein the screen and the absorbing film are electrically attached to the frame.

15. The door of claim 14 wherein the predetermined level is about 0.01 mW/cm$^2$.

16. The door of claim 14 wherein the predetermined level is established by a standard.

17. The door of claim 14 wherein the screen is arranged to attenuate microwave energy by approximately 30 dB, and wherein the absorbing film is arranged to attenuate microwave energy by approximately 20 dB.

18. The door of claim 14 wherein the screen is arranged to attenuate microwave energy by X dB, wherein the absorbing film is arranged to attenuate microwave energy by Y dB, and wherein X+Y is sufficient to attenuate leakage of the microwave energy through the door to about the predetermined level or below.

19. The door of claim 18 wherein the screen has a transparency, wherein the lines have a thickness, wherein the transparency is in a range of about 70% to about 80%, wherein the screen period is in a range of about 0.0625" to about 0.125", and wherein the thickness is in a range of about 0.00625" to about 0.020".

20. The door of claim 18 wherein the screen has a transparency, wherein the lines have a thickness and a width, wherein the transparency is about 90%, wherein the screen period is in a range of about 0.0625" to about 0.250", wherein the thickness is in a range of about 0.00313" to about 0.0125", and wherein the width is in a range of about 0.00313" to about 0.100".

21. The door of claim 18 wherein the screen has a transparency, wherein the lines have a thickness and a width, wherein the transparency is about 90%, wherein the screen period is in a range of about 0.0625" to about 0.250", and wherein a ratio of the width to the thickness is in a range of about 1.0 to about 8.0.

22. The door of claim 14 wherein the screen is more than 70% transparent, and wherein the absorbing film is more than 70% transparent.

23. The door of claim 22 wherein the screen is more than 80% transparent, and wherein the absorbing film is more than 80% transparent.

24. The door of claim 24 wherein the frame supports the screen and the absorbing film so that the screen reflects microwave energy away from the absorbing film, and so that the absorbing film absorbs microwave energy passing through the screen.

25. A door for a microwave oven, wherein the door has an interior face arranged to face an inside of the microwave oven and an exterior face arranged to face an outside of the microwave oven, the door comprising:

a screen to reflect microwave energy, arranged to attenuate microwave energy by X dB, and having a transparency in a range of about 70% to about 80% and a plurality of lines arranged to form openings having a screen period, the lines having a thickness in a range of about 0.00625" to about 0.020", and the screen period being in a range of about 0.0625" to about 0.125";

an absorbing film to absorb microwave energy and arranged to attenuate microwave energy by Y dB; and a frame supporting the screen and the absorbing film to form a window through the door, wherein the screen and absorbing film are supported by the frame so that the screen is closer to the interior face than is the absorbing film, and X+Y is sufficient to attenuate leakage of microwave energy through the door to substantially not more than a predetermined level.

26. The door of claim 25 wherein the predetermined level is about 0.01 mW/cm$^2$.

27. The door of claim 25 wherein the predetermined level is established by a standard.

28. The door of claim 25 wherein the screen is arranged to attenuate microwave energy by approximately 30 dB, and wherein the absorbing film is arranged to attenuate microwave energy by approximately 20 dB.

29. The door of claim 25 wherein the screen is more than 70% transparent, and wherein the absorbing film is more than 70% transparent.

30. The door of claim 25 wherein the screen is more than 80% transparent, and wherein the absorbing film is more than 80% transparent.

31. The door of claim 25 wherein the screen attenuates microwave energy, wherein the absorbing film attenuates microwave energy, and wherein the screen and the absorbing film are spaced by a distance so that their attenuations of microwave energy are independent.

32. The door of claim 31 wherein the distance between the screen and the absorbing film is greater than or equal to the screen period.

33. The door of claim 25 wherein the frame supports the screen and the absorbing film so that the screen reflects microwave energy away from the absorbing film, and so that the absorbing film absorbs microwave energy passing through the screen.

34. A door for a microwave oven, wherein the door has an interior face arranged to face an inside of the microwave oven and an exterior face arranged to face an outside of the microwave oven, the door comprising:

a screen to reflect microwave energy, arranged to attenuate microwave energy by X dB, and having a transparency of about 90% and a plurality of lines arranged to form openings having a screen period, the lines having a thickness in a range of about 0.00313" to about 0.0125" and a width, and the screen period being in a range of about 0.0625" to about 0.250";

an absorbing film to absorb microwave energy and arranged to attenuate microwave energy by Y dB; and a frame supporting the screen and the absorbing film to form a window through the door, wherein the screen and absorbing film are supported by the frame so that the screen is closer to the interior face than is the absorbing film, and X+Y is sufficient to attenuate leakage of microwave energy through the door to substantially not more than a predetermined level.

35. The door of claim 34 wherein the width of the lines is in a range of about 0.00313" to about 0.100".

36. The door of claim 34 wherein a ratio of the line width to the line thickness is in a range of about 1.0 to about 8.0.

37. The door of claim 34 wherein the predetermined level is about 0.01 $mW/cm^2$.

38. The door of claim 34 wherein the predetermined level is established by a standard.

39. The door of claim 34 wherein the screen is arranged to attenuate microwave energy by approximately 30 dB, and wherein the absorbing film is arranged to attenuate microwave energy by approximately 20 dB.

40. The door of claim 34 wherein the screen is more than 70% transparent, and wherein the absorbing film is more than 70% transparent.

41. The door of claim 34 wherein the screen is more than 80% transparent, and wherein the absorbing film is more than 80% transparent.

42. The door of claim 34 wherein the screen attenuates microwave energy, wherein the absorbing film attenuates microwave energy, and wherein the screen and the absorbing film are spaced by a distance so that their attenuations of microwave energy are independent.

43. The door of claim 42 wherein the distance between the screen and the absorbing film is greater than or equal to the screen period.

44. The door of claim 34 wherein the frame supports the screen and the absorbing film so that the screen reflects microwave energy away from the absorbing film, and so that the absorbing film absorbs microwave energy passing through the screen.

* * * * *